United States Patent [19]

Derichs et al.

[11] 4,175,718

[45] Nov. 27, 1979

[54] THREAD BRAKE

[75] Inventors: Josef Derichs; Gerhard Koslowski, both of Mönchen Gladbach, Fed. Rep. of Germany

[73] Assignee: W. Schlafhorst & Co., Mönchen Gladbach, Fed. Rep. of Germany

[21] Appl. No.: 973,531

[22] Filed: Dec. 26, 1978

[30] Foreign Application Priority Data

Dec. 27, 1977 [DE] Fed. Rep. of Germany ..... 2758335

[51] Int. Cl.[2] ..... B65H 59/22

[52] U.S. Cl. ..... 242/150 R; 242/148

[58] Field of Search ..... 242/150 R, 150 M, 149, 242/147 R, 131, 131.1, 148

[56] References Cited

U.S. PATENT DOCUMENTS

| | | | |
|---|---|---|---|
| 2,610,813 | 9/1952 | Campbell | 242/150 R |
| 2,888,216 | 5/1959 | Simons, Jr. et al. | 242/149 X |
| 3,459,389 | 8/1969 | Wildi et al. | 242/150 R |
| 3,533,574 | 10/1970 | Cooper et al. | 242/150 R |
| 4,133,492 | 1/1979 | Derichs et al. | 242/150 R |

*Primary Examiner*—Stanley N. Gilreath
*Attorney, Agent, or Firm*—Herbert L. Lerner

[57] ABSTRACT

Thread brake including a rotatably driven lower and upper dish, a device for applying a load with adjustable pressure to the upper dish, the device including a chamber, an elastic container of variable volume received in the chamber, and a central compressed-gas supply connected to the elastic container, the elastic container being of such size in non-pressurized condition thereof that, upon being pressurized, the elastic wall thereof is not stretched, and plunger means for transmitting the pressure from the elastic container to the upper dish, the plunger means extending through an opening formed in a wall of the chamber and having a contact surface of predetermined size directed against the elastic container.

3 Claims, 1 Drawing Figure

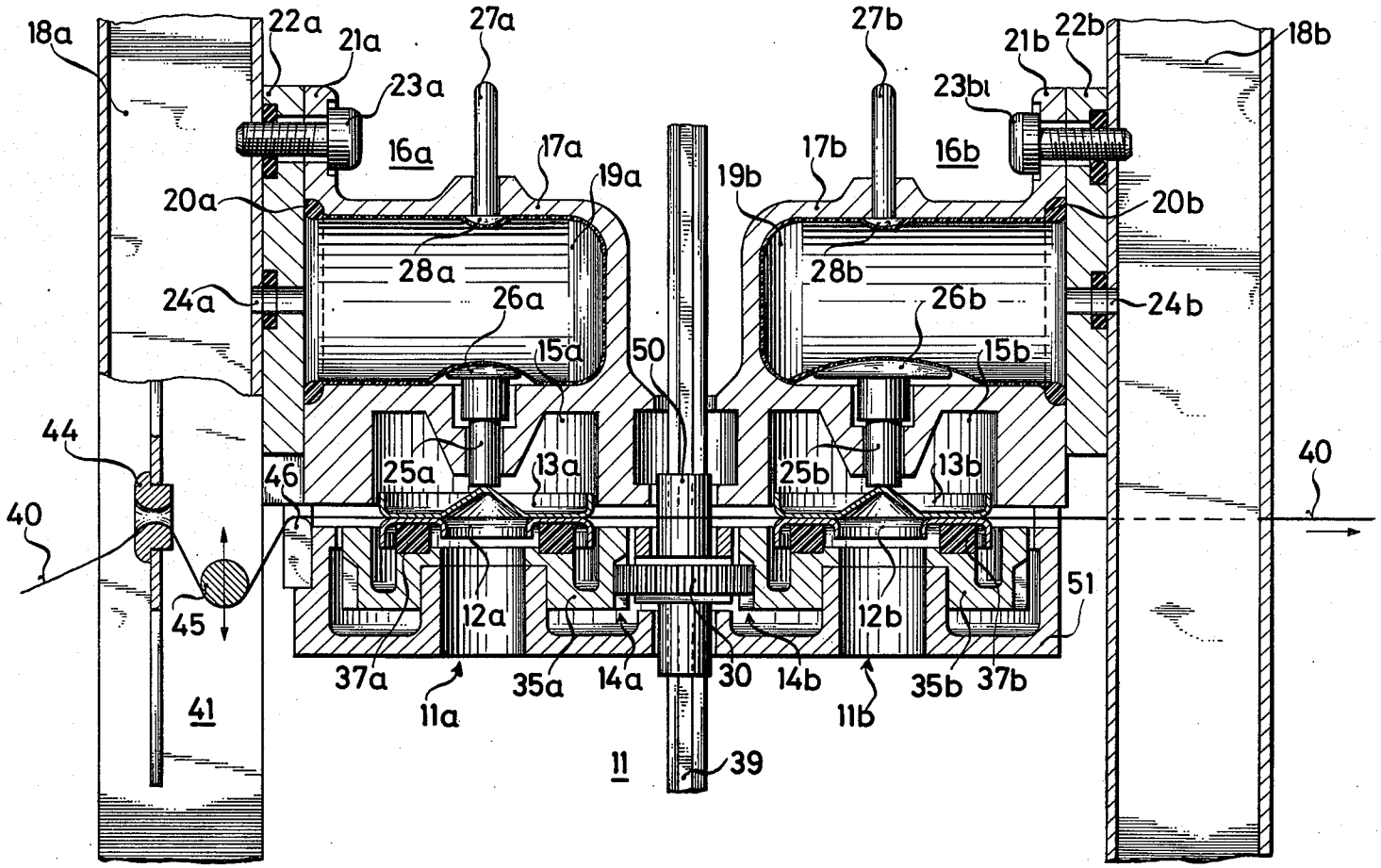
18b
40
20b
24b
22b
21b
23b1
16b
51
37b
35b
15b
26b
13b
27b
12b
11b
17b
28b
25b
14b
19b
30
39
50
11
19a
14a
17a
15a
13a
35a
27a
26a
12a
11a
28a
25a
16a
23a
21a
37a
22a
46
20a
24a
45
41
18a
44
40

THREAD BRAKE

The invention relates to a thread brake formed of a rotatably driven lower dish and an upper dish, and a device for applying a load with adjustable pressure to the upper dish, the load-applying device including a chamber wherein an elastic container of variable volume is received, the elastic container being connected to a central compressed-gas supply.

In such heretofore known thread brakes, it has been a problem to maintain constant the once-adjusted dish load and the braking action.

It is accordingly an object of the invention to provide a thread braking device wherein the braking action of an individual thread brake, also of a plurality of identical thread brakes operated in parallel, and under desirable conditions is maintained constant.

With the foregoing and other objects in view, there is provided, in accordance with the invention, a thread brake including a rotatably driven and upper dish, a device for applying a load with adjustable pressure to the upper dish, the device including a chamber, an elastic container of variable volume received in the chamber, and a central compressed-gas supply connected to the elastic container, the elastic container being of such size in non-pressurized condition thereof that, upon being pressurized, the elastic wall thereof is not stretched, and plunger means for tansmitting the pressure from the elastic container to the upper dish, the plunger means extending through an opening formed in a wall of the chamber and having a contact surface of predetermined size directed against the elastic container.

The elastic container of variable volume can be, for example, a rubber bag or bladder or the like, having a volume which, when the container is considered as a separate component situated outside the chamber, in non-pressurized inflated condition thereof but without stretching or expansion of the walls thereof, is at least equal and preferably slighly larger than the volume of the chamber wherein it is later installed. Since after assembly of the elastic container in the chamber, no forces originating from any wall expansion of the elastic container are transmitted to the plunger, the loading applied to the upper dish in addition to the plunger's own weight, is determined only by the overpressure prevailing in the elastic container and the size of the contact surface of the plunger directed against the elastic container.

If identical thread brakes are operated in parallel, the loading applied to all of the upper dishes can thus be varied solely by varying the overpressure in the central compressed-gas supply. Individual adjustments at the individual thread brakes are no longer necessary.

In accordance with another feature of the invention, especially for braking rough, uneven threads, a pair of dish combinations, respectively, comprising a lower dish and an upper dish are disposed in tandem in travel direction of a thread to be braked, the contact surface of the plunger means of the load-applying device of the dish combination located at the thread-feed side i.e. farther upstream in travel direction of the thread, being smaller than the contact surface of the plunger means of the load-applying device of the dish combination located at the thread delivery side.

The upper dish of the dish combination located at the thread feed side is therefore loaded or stressed less than is the upper dish of the dish combination located at the thread delivery side. The main loading is therefore at the thread delivery side. Practice has shown that, for example, a loading ratio of 1:4 is advantageous for many applications. The invention thus permits varying the loading solely by varying the overpressure of the compressed-gas supply, without varying the chosen loading ratio of both dish combinations. In this case, too, if the loading is to be varied, no adjusting operations of any kind are required at the individual thread brakes.

When many thread brakes are operated in parallel, it is not immediately noticed if the load-applying device of an individual thread brake no longer functions satisfactorily. In accordance with a concomitant feature of the invention, therefore, the load-applying device has a volume indicator comprising a plunger extending through a wall of the chamber thereof, the plunger having a contact surface directed against the elastic container received in the chamber of the load-applying device. Other features which are considered as characteristic for the invention are set forth in the appended claims.

Although the invention is illustrated and described herein as embodied in a thread brake, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a sectional view of a thread brake constructed in accordance with the invention.

Referring now to the drawing, there is shown a thread brake identified as a whole by reference numeral 11 and formed of two dish combinations **11*a* and 11*b*, each having a respective driven lower dish 12*a*, 12*b*, a respective upper dish 13*a*, 13*b*, a respective lower dish drive 14*a*, 14*b* and a respective loading device 16*a*, 16*b* actuatable with adjustable pressure upon the respective dish combination 11*a*, 11*b***.

Each loading device **16*a*, 16*b*, respectively, is formed of a respective chamber 17*a*, 17*b* in which a respective elastic container 19*a*, 19*b* of variable volume is received which is connectible to a respective central compressed-gas supply 18*a*, 18*b***.

The respective elastic container **19*a*, 19*b* has a respective bead 20*a*, 20*b* which is disposed in a groove formed in a respective flange 21*a*, 21*b* of the respective chamber 17*a*, 17*b* and serves as a seal against a respective counterflange 22*a*, 22*b* connected to the respective compressed-gas supply 18*a*, 18*b*. The respective flanges 21*a*, 21*b* and the respective counterflanges 22*a*, 22*b* are connected to each other by respective screws 23*a*, 23*b*. The interior of the respective compressed-gas supply 18*a*, 18*b* is connected to the interior of the respective elastic container 19*a*, 19*b* by a respective channel 24*a*, 24*b***.

To transmit the pressure from the respective elastic container **19*a*, 19*b* to the respective upper dish 13*a*, 13*b*, a respective plunger 25*a*, 25*b* is provided, extending through the wall of the respective chamber 17*a*, 17*b*, and having a respective plate 26*a*, 26*b* at an end thereof directed toward the respective elastic container 19*a*, 19*b***.

Each loading device 16a, 16b, respectively, has a respective volume indicator 27a, 27b, formed of a plunger extending through the wall of the respective chamber 17a, 17b and provided with a respective disc 28a, 28b at an end thereof directed against the elastic container 19a, 19b.

So that no additional forces are transmitted to the respective dish combination 11a, 11b by the expansion of the respective elastic container 19a, 19b, the volume of the respective elastic container 19a, 19b in non-installed condition, yet pressurelessly inflated without expansion, is greater than the volume of the respective chamber 17a, 17b. The difference in the volumes need only be slight.

The respective upper dish 13a, 13b is guided by a respective guidance housing 15a, 15b. The respective drives 14a, 14b of the lower dishes 12a, 12b have a common gear 30 and a respective gear 35a, 35b with a respective friction lining 37a, 37b disposed on the respective end face thereof, and on which the respective lower dish 12, 12b is disposed. A shaft 39 serves for the common drive of the lower-dish drives 14a and 14b.

A thread-looping device 41 is inserted into the travel path of the thread 40. The thread-looping device 41 is adjustable. It is formed of a thread grommet or eye 44, an adjustable looping member 45 and a stationary looping body 46. The plate 26a of the plunger 25a has a smaller contact surface than that of the plate 26b of the plunger 25b.

In the direction of travel, the thread 40 is first guided through the thread-looping device 41, then extends off-center between the lower dish 12a and the upper dish 13a, tangentially engages the bearing 50 of the shaft 39, extends off-center between the lower dish 12b and the upper dish 13b and, if desired, laterally deflected from the original direction thereof.

A rugged frame 51 of cast metal serves as support for the hereinaforementioned parts and ensures vibration-free travel of the thread.

The drawing illustrates normal operation. The respective compressed-gas supply 18a, 18b, serves to supply a multiplicity of identical thread brakes, is filled, in this particular case, with compressed air which has an overpressure or excess pressure of 500 mm water column against atmospheric pressure. The elastic containers 19a and 19b are inflated. Their walls rest against the respective plates 26a and 26b of the respective plungers 25a and 25b. The respective plungers 25a and 25b centrally load or stress the respective upper dishes 13a and 13b. It is readily apparent that space is left between the plates 26a and 26b, respectively and the walls of the respective chambers 17a and 17b. The elastic containers 19a and 19b have placed the respective plates 28a and 28b of the respective volume indicators 27a and 27b against the walls of the respective chambers 17a and 17b. The volume indicators 27a and 27b are thus driven outwardly. The proper filling of the elastic containers 19a and 19b is optically indicated by the respective volume indicators 27a and 27b.

Because of the reliable constancy over extended periods of time of the braking action of the novel thread brake according to the invention, the new thread brake is especially well suited for filamentary yarn in creel operation. In this regard, the loading or stressing of the individual thread brakes of the creel is centrally controllable from the respective compressed-gas supply 18a, 18b through appropriate selection of the overpressure. In addition, the loading or stressing can also be varied by replacing the plungers 25a and 25b with other plungers having larger or smaller respective plates 26a and 26b.

Alternatively, both dish combinations 11a and 11b can be acted upon by a single elastic container, which is then suitably large or long.

There are claimed:

1. Thread brake comprising a lower dish and upper dish, said dishes having confronting surfaces for engaging a thread passing therebetween, a device for applying a load with adjustable pressure to said upper dish for biasing said upper dish towards said lower dish, said device comprising a chamber, an elastic container of variable volume received in said chamber, and a central compressed-gas supply connected to said elastic container, said elastic container being of such size in non-pressurized condition thereof that, upon being pressurized, the elastic wall thereof is not stretched, and plunger means for transmitting the pressure from said elastic container to said upper dish, said plunger means extending through an opening formed in a wall of said chamber and having a contact surface of predetermined size directed against said elastic container.

2. Thread brake according to claim 1 wherein, in travel direction of a thread to be braked, a pair of dish combinations, respectively, comprising a lower and an upper dish are disposed in tandem, a respective chamber elastic container and plunger means being associated with each of said dish combinations, respectively, the contact surface of said plunger means disposed farther upstream in said travel direction of the thread being smaller than the contact surface of said plunger means disposed farther downstream in said travel direction of the thread.

3. Thread brake according to claim 1 or 2 wherein said load-applying device has a volume indicator comprising a plunger extending through a wall of said chamber thereof, said plunger having a contact surface directed against the elastic container received in said chamber of said load-applying device.

* * * * *